United States Patent [19]

Singrey

[11] 4,190,415

[45] Feb. 26, 1980

[54] CHIP DRYING AND CLEANING DEVICE

[76] Inventor: Raymond E. Singrey, R.D. #1, Williamsfield, Ohio 44093

[21] Appl. No.: 923,474

[22] Filed: Jul. 10, 1978

[51] Int. Cl.[2] ..... F27B 15/00; F26B 17/00

[52] U.S. Cl. ..... 432/58; 34/57 E; 432/14

[58] Field of Search ..... 432/58, 14, 13; 34/57 E

[56] References Cited

U.S. PATENT DOCUMENTS

| | | | |
|---|---|---|---|
| 1,964,915 | 7/1934 | Haswell | 432/58 |
| 2,412,057 | 12/1946 | Nichols | 432/14 |
| 2,630,310 | 3/1953 | Harshberger | 432/58 |
| 2,911,730 | 11/1959 | Schaub et al. | 34/57 E |
| 3,834,860 | 9/1974 | Fukuda et al. | 432/58 |
| 3,989,446 | 11/1976 | Grill et al. | 432/58 |
| 4,088,438 | 5/1978 | Deussner et al. | 432/58 |

*Primary Examiner*—John J. Camby

*Attorney, Agent, or Firm*—Webster B. Harpman

[57] ABSTRACT

An apparatus for chip drying and cleaning of ferrous or non-ferrous metals comprising a vertical cylinder with tangentially mounted burners therein. A material feeding device is positioned above the high velocity hot gases of the burners so that a cyclonic action cleans or dries the material within the cylinder.

3 Claims, 2 Drawing Figures

CHIP DRYING AND CLEANING DEVICE

BACKGROUND OF THE INVENTION (1) Field of the Invention

This invention relates to treatment of finely divided materials.

(2) Description of the Prior Art

Prior devices have utilized furnace apparatus for sintering and fusing the finely divided metalliferous materials. See for example U.S. Pat. No. 1,964,915 to A. B. Haswell of July 3, 1934, U.S. Pat. No. 2,412,057 to C. W. Nichols of Dec. 3, 1946, U.S. Pat. No. 3,834,860 to Fukuda et al of Sept. 10, 1974 and U.S. Pat. No. 3,989,446 to Grill of Nov. 2, 1976.

In U.S. Pat. No. 2,412,057 a furnace construction is disclosed having two chambers wherein hot gases generated in the lower chamber flow upward through the material to be cleaned.

The present invention utilizes a cyclonic scrubbing action within a single chamber.

U.S. Pat. No. 1,964,915 shows a sintering and fusing apparatus for finely divided materials wherein the material flows in under air pressure and the exhaust gases are vented through the bottom of the furnace.

In the present invention the material to be treated is delivered above tangentially mounted high velocity burners which are vented through a lower centrally mounted stack thereby inhancing the cyclonic action.

U.S. Pat. No. 3,834,860 discloses a heating device wherein pulverized material to be treated is injected into the air stream of the supply air duct in a horizontal combustion chamber.

In the present invention the material is dropped directly into the paths of high velocity burners within a single vertically standing chamber.

In U.S. Pat. No. 3,989,446 an aqueous solution of magnesium chloride is sprayed into a kiln chamber below the exhaust vent. Some untreated material is carried out through the exhaust and reintroduced at a lower point within the chamber.

In the present invention the vent location, burner velocity and chamber design prevents any treated or untreated material from being moved outwardly of the vent.

SUMMARY OF THE INVENTION

A device for drying or cleaning metallic chips comprises a vertical cylinder having tangentially mounted high velocity burners creating downwardly and upwardly cyclonic oxidizing flow. A material feeding device directs material to the upper end of the cylinder above the burners. A vent extends to a central position below the burners.

DESCRIPTION OF THE PREFERRED EMBODIMENT

Figure 1:
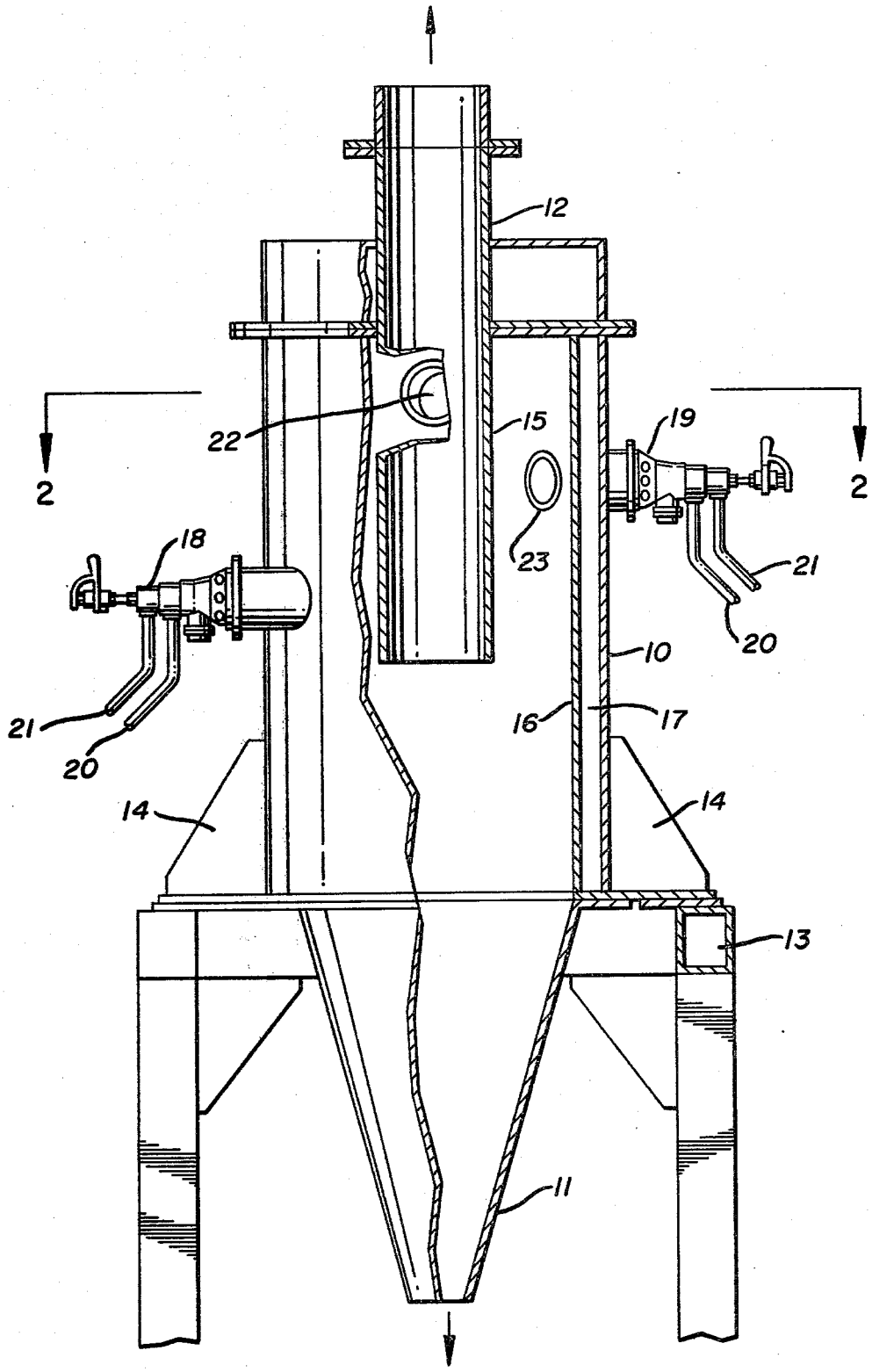
FIG. 1 is a front plan view with parts cut away of the chip dryer and cleaning device.

The chip drying and cleaning device as seen in FIG. 1 of the drawings comprises an outer vertically positioned cylindrical body 10 having a cone-shaped bottom 11 and a closed top 12 thereon. A frame 13 supports and is secured to the cylindrical body 10 by a plurality of angular braces 14. An elongated tubular stack 15 is positioned centrally through the top 12 to a point inwardly of the upper and lower ends of the cylindrical body 10 and acts as an exhaust stack for the device. An inner cylindrical body 16 is positioned in spaced relation to the cylindrical body 10. The space between the two cylindrical bodies 10 and 16 can be used as a water jacket 17 or filled with refractory lining.

Figure 2:
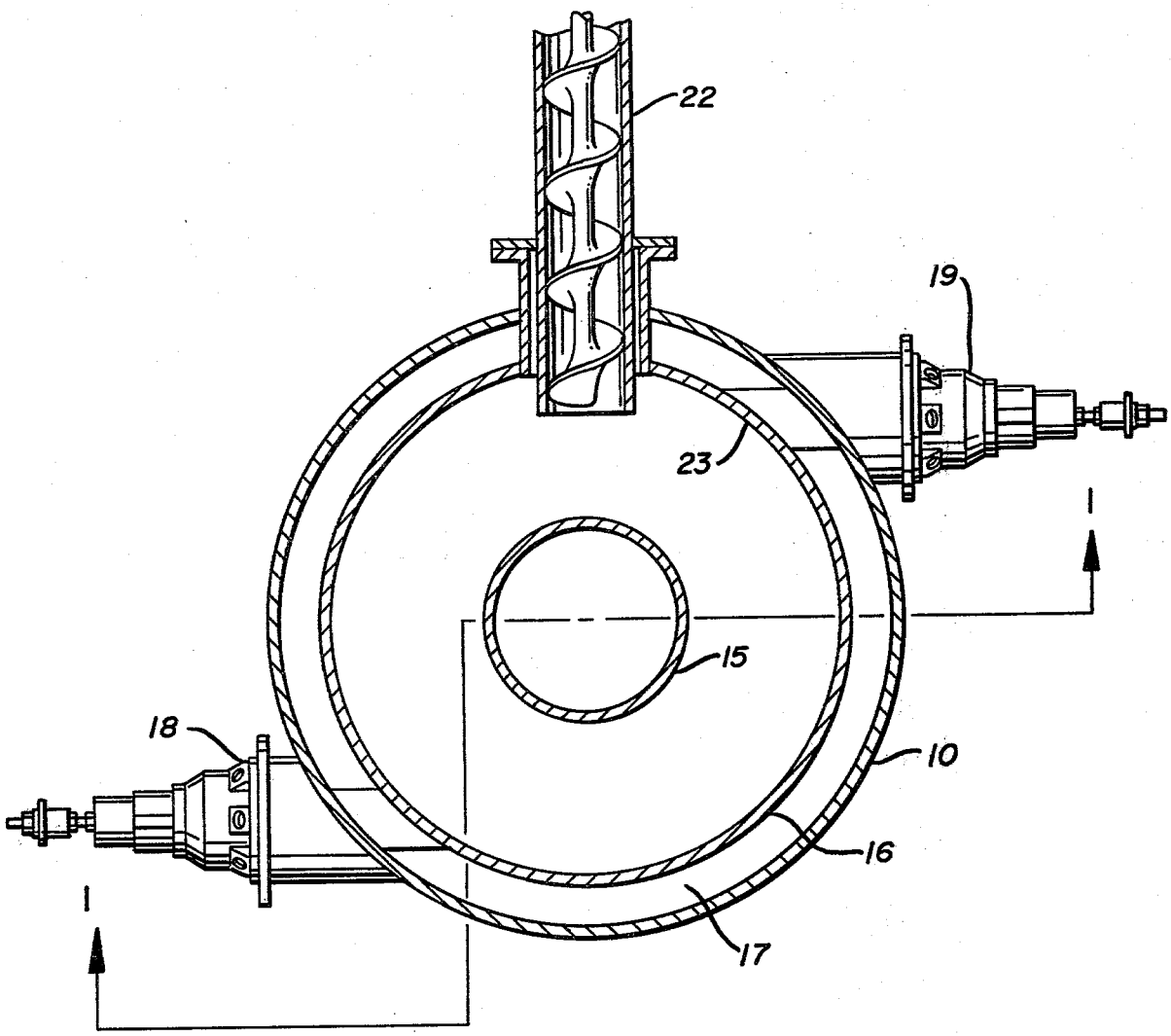
FIG. 2 is a top section taken on lines 2—2 of FIG. 1.

As seen in FIGS. 1 and 2 of the drawings, a pair of burners 18 and 19 are mounted tangentially on and extending through both the cylindrical walls 10 and 16. Each of the burners 18 and 19 have fuel supply lines 20, and air supply lines 21 in communication therewith. The burners 18 and 19 are commonly available high velocity oil type such as model number 6425MB manufactured by North American Manufacturing Company of Cleveland, Ohio. A material feed auger assembly 22 is positioned through both the cylindrical bodies 10 and 16 and extends inwardly of the body 16 for delivering material above the horizontal plane of the inlet port 23 of the burner 19. The two burners 18 and 19 create a high velocity downwardly and upwardly flowing cyclonic stream of hot gases that dries and oxidizes the foreign substance on the material being treated as it passes down through the cyclonic vortex. Due to the downwardly flowing cyclonic hot gases and the centrifugal force imparted thereby to the material being treated and low placement of the exhaust stack 15 within the device, only the oxidized foreign material and spent hot gases are vented to the atmosphere. The processed material drops down into the cone portion 11 of the cylindrical body 10 to a receiving enclosure (not shown).

The cyclonic thermal scrubbing action of the chip drying and cleaning device can be used for a variety of ferrous and non-ferrous waste material such as metal turnings, burs or coated sand and aggregate. The size and number of burners varies in accordance to the type of contaminates to be removed such as (oil, water, and chemical residue).

The high temperatures utilized, 2500° to 3200° F. allow for an increase in fuel effeciency by utilizing the oxidized foreign substance removed from the various materials being treated as fuel.

Although but one embodiment of the present invention has been illustrated and described, it will be apparent to those skilled in the art that various changes and modifications may be made without departing from the spirit of the invention and having thus described my invention what I claim is:

1. A chip or sand drying and cleaning device comprising a vertically positioned cylindrical body forming a hollow unrestricted oxidizing chamber, an open ended cone-shaped bottom on the lower end of said cylindrical body, a closure on the upper end thereof, at least two tangentially mounted burners on said cylindrical body in communication therewith, a fuel source for said burners, means located above said burners for delivering contaminated material into said cylindrical body, said burners and the products of combustion therefrom acting to create a high velocity cyclonic vortex whereby the contaminates are oxidized, tubular means extending downwardly through said closure centrally thereof for exhausting said products of combustion and said oxidized contaminates, the lower intake end of said tubular means communicating within said oxidizing chamber centrally thereof and below said burners and within said cyclonic vortex, the inner area of said cylindrical body being at least double the area of the tubular means for exhausting the products of combustion so that said cyclonic vortex will be unimpeded in imparting centrifugal spin to said contaminated material so as to carry it below said intake end of said tubular means and into said open ended cone-shaped bottom.

2. The chip or sand drying and cleaning device of claim 1 wherein said burners are in circumferentially spaced relation to each other.

3. The chip or sand drying and cleaning device of claim 1 wherein said means above said burners for delivering contaminated material into said cylindrical body extends into said cylindrical body beyond the inner surface thereof so as to deliver said contaminated material into said cyclonic vortex.

* * * * *